US006486858B1

(12) United States Patent
Altman

(10) Patent No.: US 6,486,858 B1
(45) **Date of Patent: *Nov. 26, 2002**

(54) METHOD FOR CREATING A TWO-DIMENSIONAL IMAGE

(76) Inventor: Mitchell A. Altman, 572 Hill St., Penthouse, San Francisco, CA (US) 84114

( * ) Notice: Subject to any disclaimer, the term of this patent is extended or adjusted under 35 U.S.C. 154(b) by 0 days.

This patent is subject to a terminal disclaimer.

(21) Appl. No.: 09/866,384

(22) Filed: May 25, 2001

Related U.S. Application Data

(63) Continuation of application No. 09/347,781, filed on Jul. 6, 1999, now Pat. No. 6,239,774, which is a continuation of application No. 08/740,647, filed on Oct. 31, 1996, now abandoned.

(60) Provisional application No. 60/008,151, filed on Oct. 31, 1995.

(51) Int. Cl.[7] ..... G09G 3/00

(52) U.S. Cl. ..... 345/31; 345/82

(58) Field of Search ..... 345/31, 39, 46, 345/82

(56) References Cited

U.S. PATENT DOCUMENTS 3,737,722 A * 6/1973 Scharlack ..... 345/39
4,162,493 A * 7/1979 Ross et al. ..... 345/59
4,470,044 A * 9/1984 Bell ..... 345/31
5,406,300 A * 4/1995 Tokimoto et al. ..... 345/61
5,548,300 A * 8/1996 Tokimoto ..... 345/39
5,644,328 A * 7/1997 Rhyne et al. ..... 345/82
5,670,971 A * 9/1997 Tokimoto et al. ..... 345/31
6,239,774 B1 * 5/2001 Altman ..... 345/31

FOREIGN PATENT DOCUMENTS

GB 0 277 189 A * 10/1994

* cited by examiner

*Primary Examiner*—Jeffery A. Brier
(74) *Attorney, Agent, or Firm*—Knobbe Martens Olson & Bear, LLP

(57) ABSTRACT

A method of creating an image involves providing a plurality of light sources arranged in a one-dimensional matrix. The one-dimensional matrix is made up of a vertical column and at least two horizontal rows in which each of the horizontal rows has no more than one of the light sources. The light sources are blinked at their safe maximum current for at least two image_times that are within the range from about 30 milliseconds to about 200 milliseconds without damaging the light sources or electronic circuity controlling the light sources. Each of the image_times includes two or more display_times that are equal to LED On time. The light sources are moved relative to an observer, such that the observer will observe a two-dimensional image.

11 Claims, 8 Drawing Sheets

FIG. 5A1

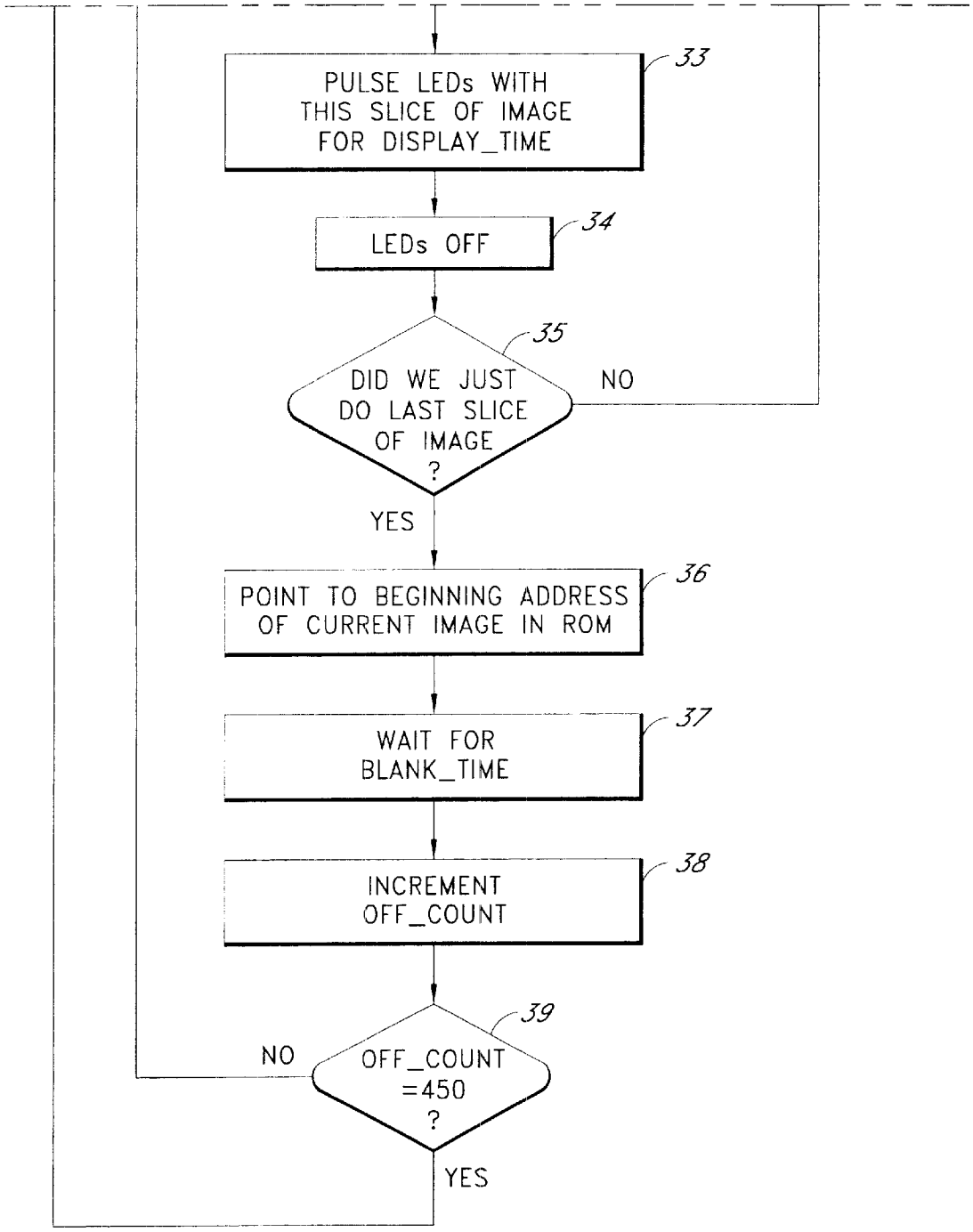
FIG. 5A$_2$

FIG. 5B1

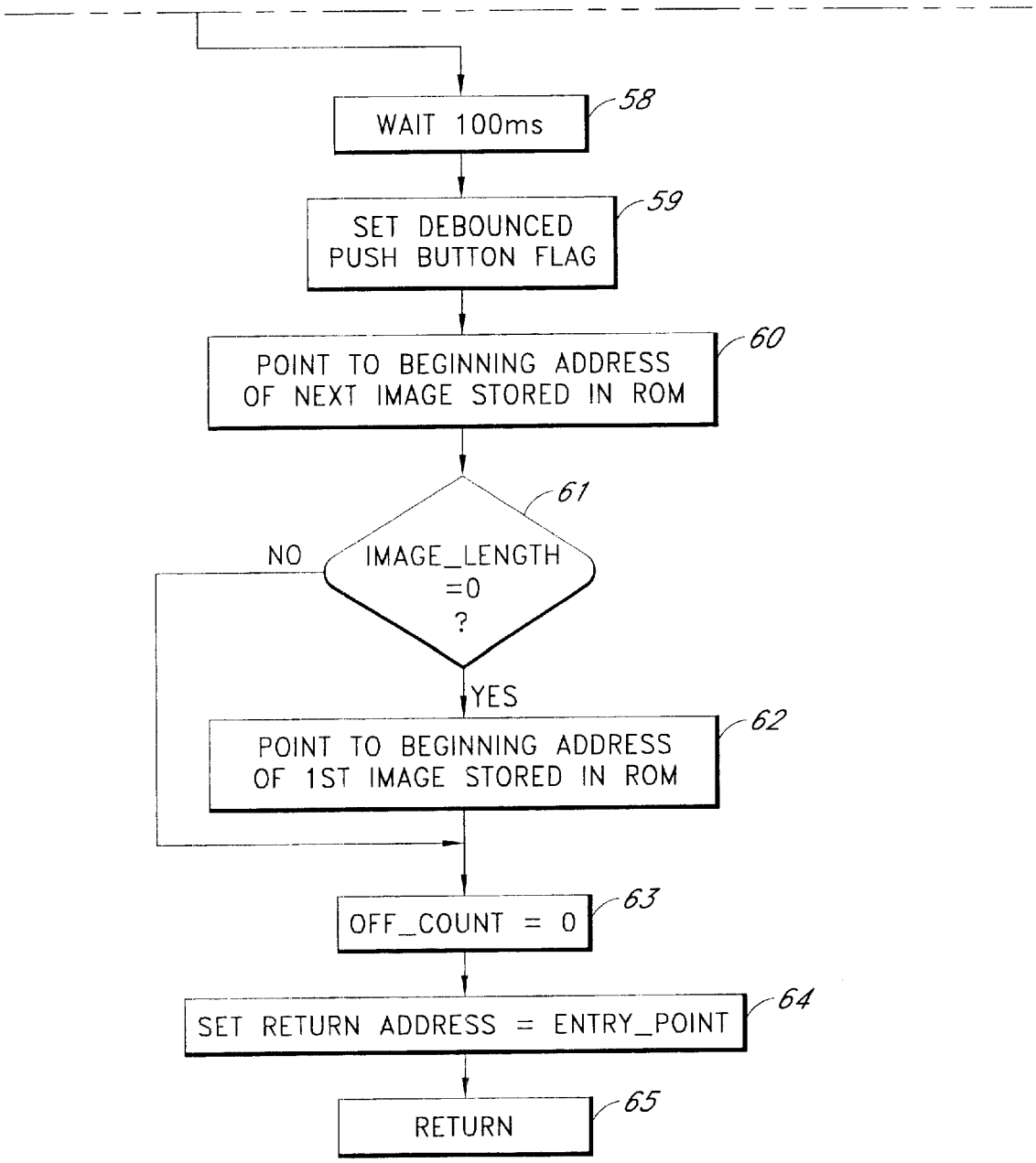
FIG. 5B$_2$

METHOD FOR CREATING A TWO-DIMENSIONAL IMAGE

RELATED APPLICATIONS

The present application is a continuation of application Ser. No. 09/347,781 filed Jul. 6, 1999,"now U.S. Pat. No. 6,239,774," which is a continuation of application Ser. No. 08/740,647 filed Oct. 31, 1996, "now abandoned" which claims the benefit of priority under 35 U.S.C. §119(e) from provisional application Ser. No. 60/008,151, filed Oct. 31, 1995. All of these prior applications are hereby incorporated by reference in their entirety.

BACKGROUND OF THE INVENTION

1. Field of the Invention

The present invention relates to electronic novelty items, and more particularly to electronic devices which generate a two-dimensional image from a one-dimensional column of light sources.

2. Description of the Related Art

There are a large variety of novelty applications, such as toys, promotions, advertising, safety, information displays, etc., where being able to attract attention is important. The public's attention to many attention-getting techniques is generally short-lived. Thus, there is a constant need for new novelty applications.

Bell, in U.S. Pat. No. 4,470,044 developed a technique for producing a two-dimensional image from a single column of LED's to an observer subject to saccadic eye movements. In this device, the column of LED's was stationary and blinked at a frequency specifically set to produce a two-dimensional image from the saccadic eye movements of the observer. However, the device was not designed to be used in connection with a moving column of lights and was too expensive to be used in connection with many novelty applications.

SUMMARY OF THE INVENTION

One aspect of the present invention relates to an image-creating implement. This implement includes a plurality of light sources, such as LED's, arranged in a one-dimensional matrix, The one-dimensional matrix includes a vertical column and a plurality of horizontal rows in which each of the horizontal rows has no more than one of the light sources. The implement also includes electronic circuitry which is. adapted to blink each of the light sources in a manner such that when the matrix is moved an observer thereof will observe a two-dimensional image. The electronic circuitry provides an image_time for each of the light sources within the range from about 30 milliseconds to about 200 milliseconds. The implement can also include a handle supporting the plurality of light sources, In a preferred embodiment, the matrix of the image-creating implement has only one column. The image-creating implement can be attached to a variety of other devices, including to a spoke of a bicycle wheel or a pendulum. Especially preferred two-dimensional images when the device is attached to a pendulum are the time andlor date. The image-creating implement can also be attached to a motor vehicle, such as to the antenna, windshield-wiper or window thereof. In one preferred embodiment, the electronic circuitry includes a ROM which contains a program that causes the light sources to blink in such a manner to create the two-dimensional image, a microcontroller which executes the program stored in the ROM, a RAM which stores variables from the program, a time base generator for timing the microcontroller, and a power supply which supplies power to the microcontroller, the ROM, the RAM, the time base generator and the light sources. The power supply can be one or more batteries, a DC output from an AC power converter, or a DC output from a DC to DC converter. In particular forms of the implement, the electronic circuitry includes no more than the ROM, the microcontroller, the RAM, the time base generator and the power supply, other than things which do not materially affect the function of the circuitry. Thus, there are particular forms of the implement which have neither a line driver nor a current limiting device. However, the electronic circuitry can also include other components, such as a current limiting device to ensure that excess current does not flow through the light sources or the microcontroller or a line driver to allow a large amount of current to flow through the light sources without damaging the microcontroller. Additional optional components of the electronic circuitry include a back and forth sensor which is adapted to turn on and off the implement or to identify which direction the implement is travelling and place the two dimensional image in a single orientation regardless of which direction the implement is travelling, or a switch adapted to turn on and off the implement or to update the implement to produce a second two-dimensional image.

Another aspect of the present invention relates to a method of creating an image. This method includes the step of providing a plurality of light sources arranged in a one-dimensional matrix. The one-dimensional matrix used in this method includes a vertical column and a plurality of horizontal rows in which each of the horizontal rows has no more than one of the light sources. The method further includes blinking each of the light sources for a plurality of image_times, in which each of the image_times is within the range from about 30 milliseconds to about 200 milliseconds, and moving the plurality of light sources relative to an observer, such that the observer will observe a two-dimensional image. The blinking step can be accomplished by electronic circuitry programmed to produce the image_times. Each of the image_times can be followed by a blank_time, which is preferably within the range from about 880 microseconds to about 200 milliseconds, and more preferably within the range from about 3 milliseconds to about 200 milliseconds. The moving step can comprise rotating, linear motion, back and forth motion or any other motion. In one preferred embodiment in which back and forth motion is used, the method also can include reversing the orientation of the two-dimensional image depending on which direction the implement is travelling. The method can be readily adapted to display a second and subsequent two-dimensional images.

DETAILED DESCRIPTION OF THE PREFERRED EMBODIMENT

Introduction

The "Persistent Image Maker" consists of a column of lights and electronics circuitry to blink the individual lights in the column of lights in such a manner so that when the column of lights is stationary people looking directly at it will only perceive a flickering column of lights, but when the column of lights is moved—movement can be back and forth, or in a continuous motion, or spinning in a circle, or in any other fashion—an image is perceived to appear across the space through which the column of lights was moved. If the column of lights is moved across a space once, the image will only be perceived briefly, but if the column of lights is continually moving (e.g., back and forth or if it is spinning in a circle), the image will be perceived to persist for as long as the perceivers keep looking at the space through which the column of lights is moving.

Figure 1:
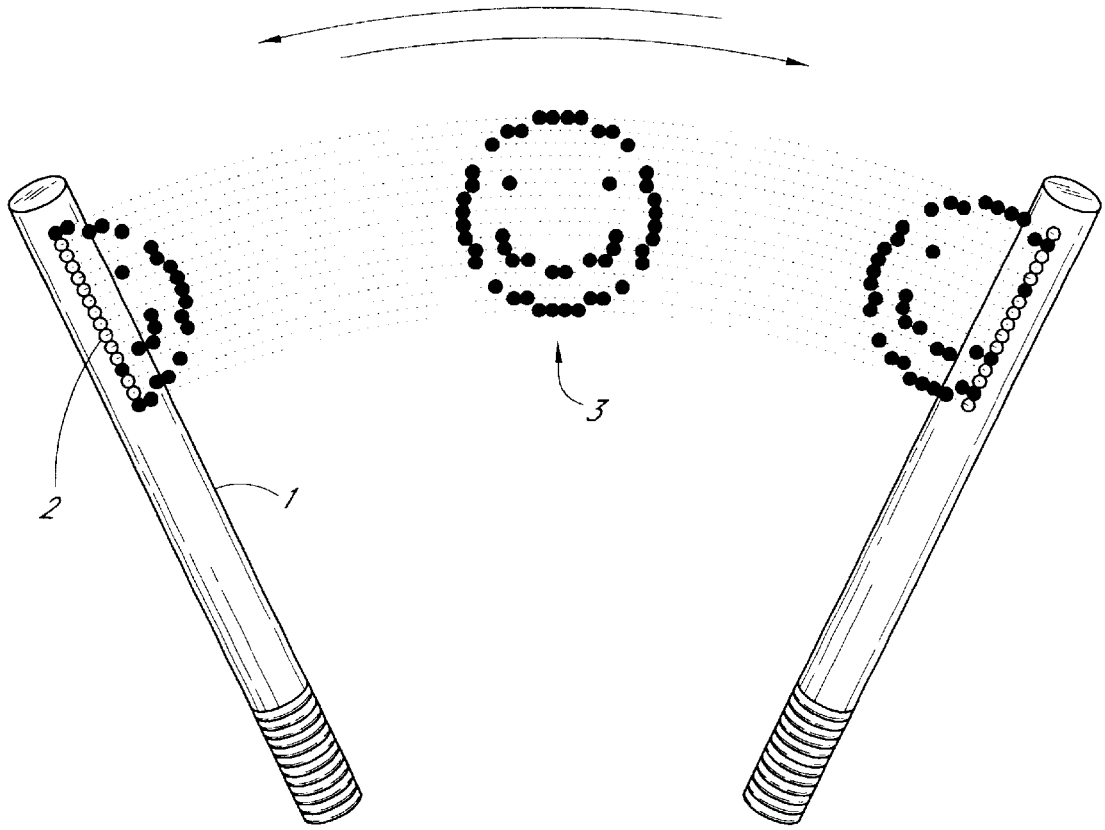
FIG. 1 is a persistent image-maker of the present invention shown in the column of lights mounted on the end of a wand being moved back and forth and generating a smiley face image.

FIG. 1 shows a "Persistent Image Maker" with the column of lights (2) mounted on the end of a wand (1) being moved back and forth and generating a smiley face image (3).

There are many ways to implement a device that performs as described above. The "Persistent Image Maker" uses an implementation with very few parts, all of them inexpensive, making the "Persistent Image Maker" very inexpensive manufacture.

Preferred Use

The "Persistent Image Maker" is designed specifically to be used as a building block for use in an application that moves with respect to those looking at it (see Applications, below). Although a person can perceive an image produced by the "Persistent Image Maker" while the "Persistent Image Maker" is stationary (if the person moves their eyes, an image will be perceived), the "Persistent Image Maker" is specifically designed so that a person will easily perceive images while the "Persistent Image Maker" is in motion. The timing of the blinking of the individual lights in the column of lights is what determines the ease with which an image can be perceived while the "Persistent Image Maker" is in motion. (E.g., experimentation has shown that in a typical application, if the "Persistent Image Maker" takes about 50 msec to display an entire image, a person can easily perceive an image if they are waving an "Imaginary Image Wand" back and forth. (See Range of Timing Values, below.)

Images Displayed

The "Persistent Image Maker" can produce a variety of images, from pictures to letters and words. Pictures are easiest for most viewers to perceive, though short words are easily perceived as well.

The design of the "Persistent Image Maker" makes it particularly well suited for low-resolution images that will be viewable in an environment with dim lighting. [Experimentation has shown that for people to be able to easily perceive an image, the resolution can be very low, e.g., using only 16 lights in the column of lights used in an "Imaginary Image Wand" (see Applications, below), people can easily perceive up to 5-letter words, and perceive simple pictures. Experimentation has also shown that the darker the environment that the "Persistent Image Maker" is moving in, the easier it is for people to perceive the images produced by it.

The "Persistent Image Maker" can have many images stored into it, the number, resolution and complexity only limited by the amount of storage that can hold the images, e.g., for a 16-light column of lights, 4 simple pictures and 4 short words can be stored in 1K of ROM with no data compression—using data-compression it is possible to store many more images.

If there is more than one image stored in a "Persistent Image Maker" they can each be displayed for a period of time, one followed by the next. Alternatively, there can be a push-button switch that the user can momentarily push to advance the "Persistent Image Maker" to display the next image.

Figure 2A:
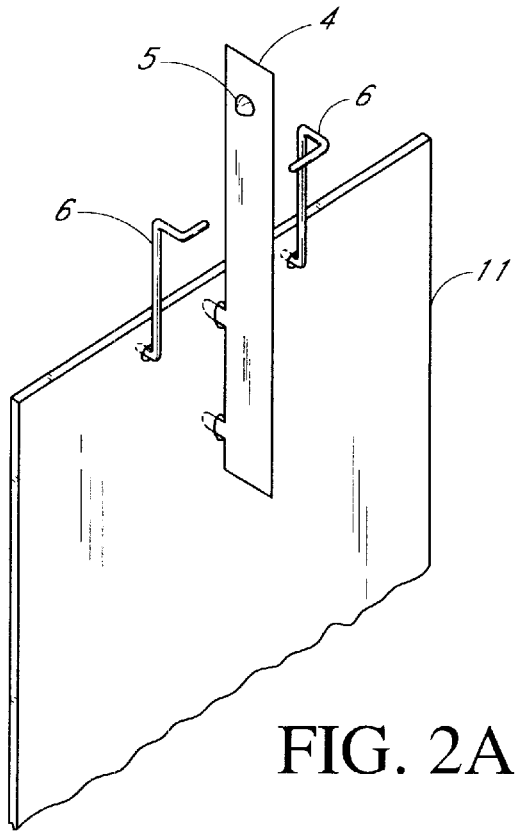
FIG. 2*a* shows detail of the mounting of a flexible metal strip as a back and forth sensor.
Figure 2B:
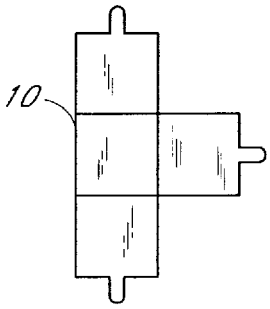
FIG. 2*b* shows detail of the mounting of a metal cage and a ball bearing as a back and forth sensor.
Figure 2B:
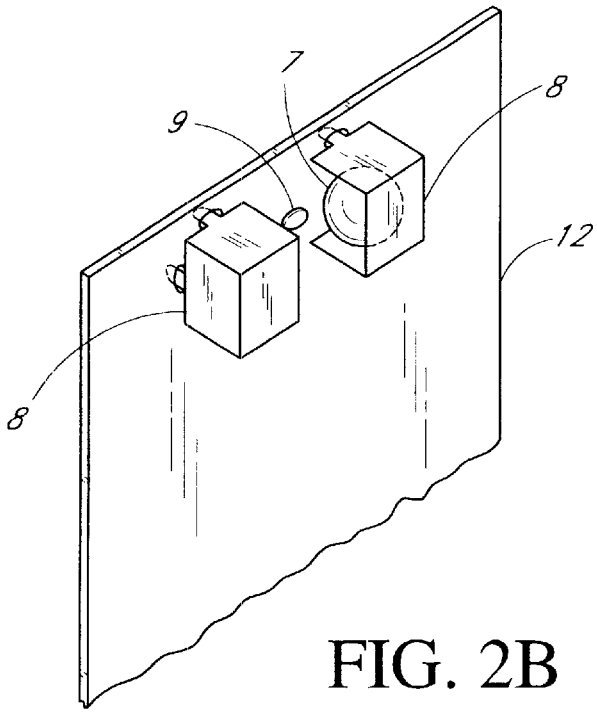

If the "Persistent Image Maker" is to be used in a back and forth motion (such as with an "Imaginary Image Wand"—see Applications, below), an optional sensor can be added to the basic design to detect when the "Persistent Image Maker" is moving "back" or "forth." Without this added feature, the "Persistent Image Maker" is always generating the image in the same direction, and so the image is seen properly while the "Persistent Image Maker" is moving "back" and a mirror-image is seen when the "Persistent Image Maker" is moving "forth." As will be described below, this is not often a problem since most people will "see" but not "notice" this phenomena. But for some applications, it will be useful to ensure that people viewing the generated images perceive only the image proper and not the mirror-image. There are many ways to implement the sensor, For example (see FIG. 2*a*), a flexible metal strip (4) with a small weight (5) attached to the end of it so that the flexible metal strip (4) can touch either one of two contacts (pieces of stiff bent wire) (6) depending on which way it flexes, thus forming a Single-Pole-Double-Throw switch which works as follows: when going "back" the flexible metal (4) touches one metal contact (6) which tells the controller in the "Persistent Image Maker" to display the image forwards; when going "forth" the flexible metal (4) touches the other metal contact (6) which tells the controller in the "Persistent Image Maker" to display the image backwards—the net result being that the image comes out looking "forward" no matter which way the "Persistent Image Maker" is moving. The image will also appear to be brighter, since the perceiver will be perceiving twice as much useful information. The flexible metal strip (4) and the two contacts (6) are mounted directly to the PC board of the "Persistent Image Maker" (11). Another way to detect "back" and "forth" (see FIG. 2*b*) is to have a ball bearing (7) inside of a "cage" (8) made-up of two cut and bent pieces of metal, so that as the "Persistent Image Maker" goes back and forth, the ball bearing (7) is propelled to one piece of bent metal (8) or the other (8), and no matter which it is touching, it is also touching a metal contact (9) in the middle, underneath it. This creates a Single-Pole-Double-Throw switch which can then be used as described in the previous example. The "cages" (8) and the metal contact (9) are mounted directly to the PC board of the "Persistent Image Maker" (12). FIG. 2*b* also shows a diagram for the pieces of metal (10) before they are bent to form "cages" (8). Experiments have shown that although most people will perceive mirror-images in addition to the intended images, most people will unconsciously ignore the mirror-image since people tend to pay attention mainly to what "makes sense," and ignore everything else. Because of this, for most applications it is not important to ensure that people not perceive the mirror-image, and so, for most applications it is not necessary to detect "back" and "forth."

Applications

Because it is so inexpensive, the "Persistent Image Maker" is suitable as a building block for a large variety of applications, such as toys, promotions, advertising, safety, information displays, etc., etc. For example, in what I call an "Imaginary Image Wand," the column of lights of a "Persistent Image Maker" is placed on the end of a wand that a person can wave back and forth to produce images—in this case the images can be suited for use as a toy, or for events such as birthdays, celebrations, street fairs, concerts, sports, conventions, politics, or the images can be suited for promotion, such as "business cards." In what I call a "Safety Spoke Spook," the column of lights of a "Persistent Image Maker" attaches to the spokes of a bicycle wheel, and the rotation of the bicycle wheel produces the images—in this case the light emitted draws attention of motorists to the bicycle at night, and the images are suited for this concept. In what I call a "Virtual Vision Clock," the column of lights of a "Persistent Image Maker" is attached to the bottom of a pendulum that swings back and forth once per second so that the swinging of the pendulum produces an image—and in this case, the image is the time of day, and/or the date, and/or pictures and/or words for novelty, promotion, and/or advertising. (The "Virtual Vision Clock" requires electronics and/or mechanics for the pendulum (e.g., magnets and electromagnets) in addition to the "Persistent Image Maker".)

Other ideas include (but are not limited to) attaching the column of lights of the "Persistent Image Maker" on cars' antennae; on cars' windshield-wipers; on the bottom of a pendulum that is hanging from a suction-cup on cars' side-windows.

HOW THE "PERSISTENT IMAGE MAKER" WORKS

Functional description

Conceptually, the "Persistent Image Maker" is simple. It is a single-column version of a common light display that is very popular for displaying "time and temperature" in front of banks. In many of the "time and temperature" displays the information appears to be moving to the left (or to the right). The "time and temperature" display has many columns of lights in a row. An image is displayed on these lights by individually turning each light on or off so that a viewer will perceive letters, words and/or pictures. To make the image appear to be moving to the left, after the image is displayed for a short amount of time (less than a second), the information on each column of lights is duplicated on the column immediately to its left, and the further most right column of lights is given the thin slice of the image that was previously unseen. Functionally, the "Persistent Image Maker" is almost identical to the "time and temperature" display except that there is only one column of lights and the image is "moving" much faster. In the "time and temperature" display, the viewer sees all of the information on all of the columns of lights of the display at once—for the "Persistent Image Maker," since there is only one column of lights, only a thin slice of the information is on the display at a given moment, the rest of the information is in the viewer's perception (previously shown slices of information are in the viewer's eyes by persistence of vision, and in the viewer's brain where the information is being processed, part of that processing being continually trying and succeeding to make "sense" out of what it is being processed).

Figure 3:
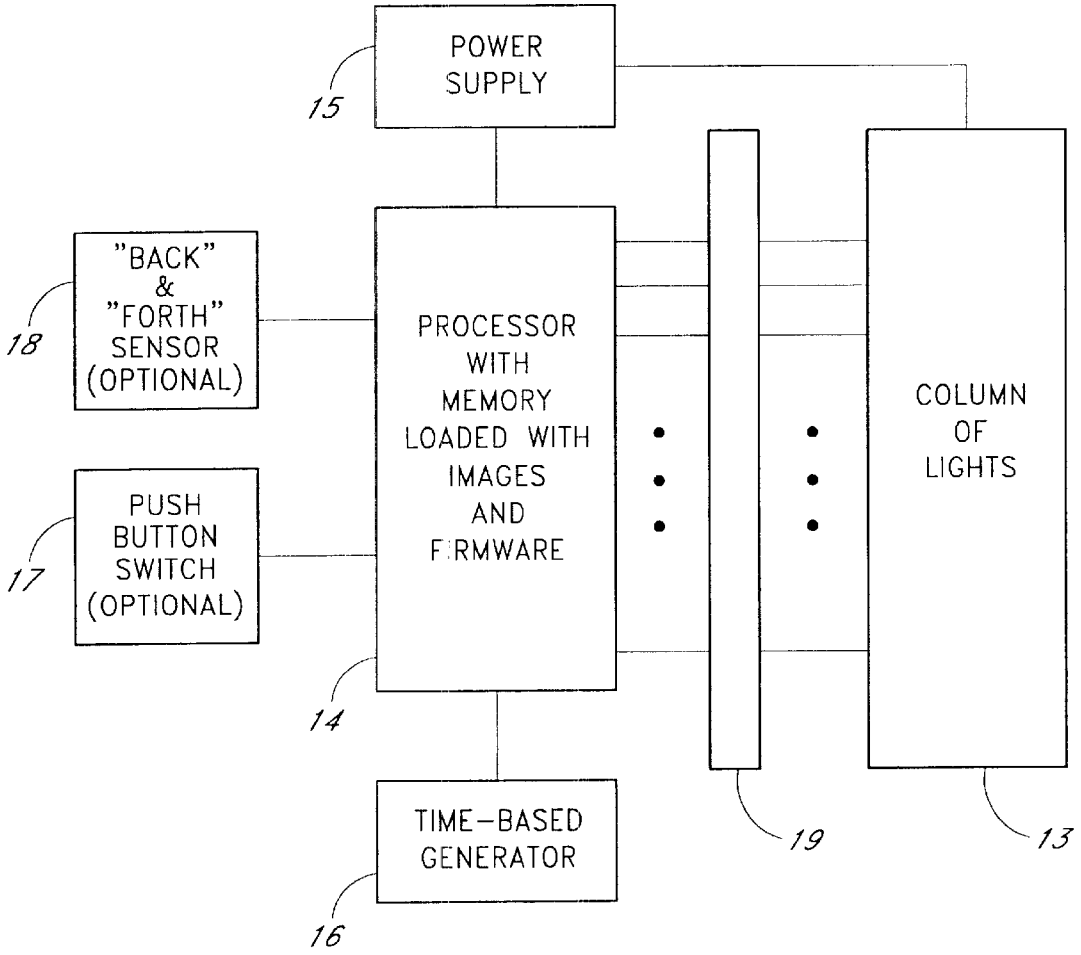
FIG. 3 shows a generic block diagram of the persistent image-maker.

A block diagram for the "Persistent Image Maker" is shown in FIG. 3. It consists of a column of lights (13), a processor (containing memory with the processor's program and with the images stored in it) (14), a power supply (15), a time base generator (16), an optional push-button switch (17), an optional "back" and "forth" sensor (18), and an optional set of current limiting devices (19).

Figure 4:
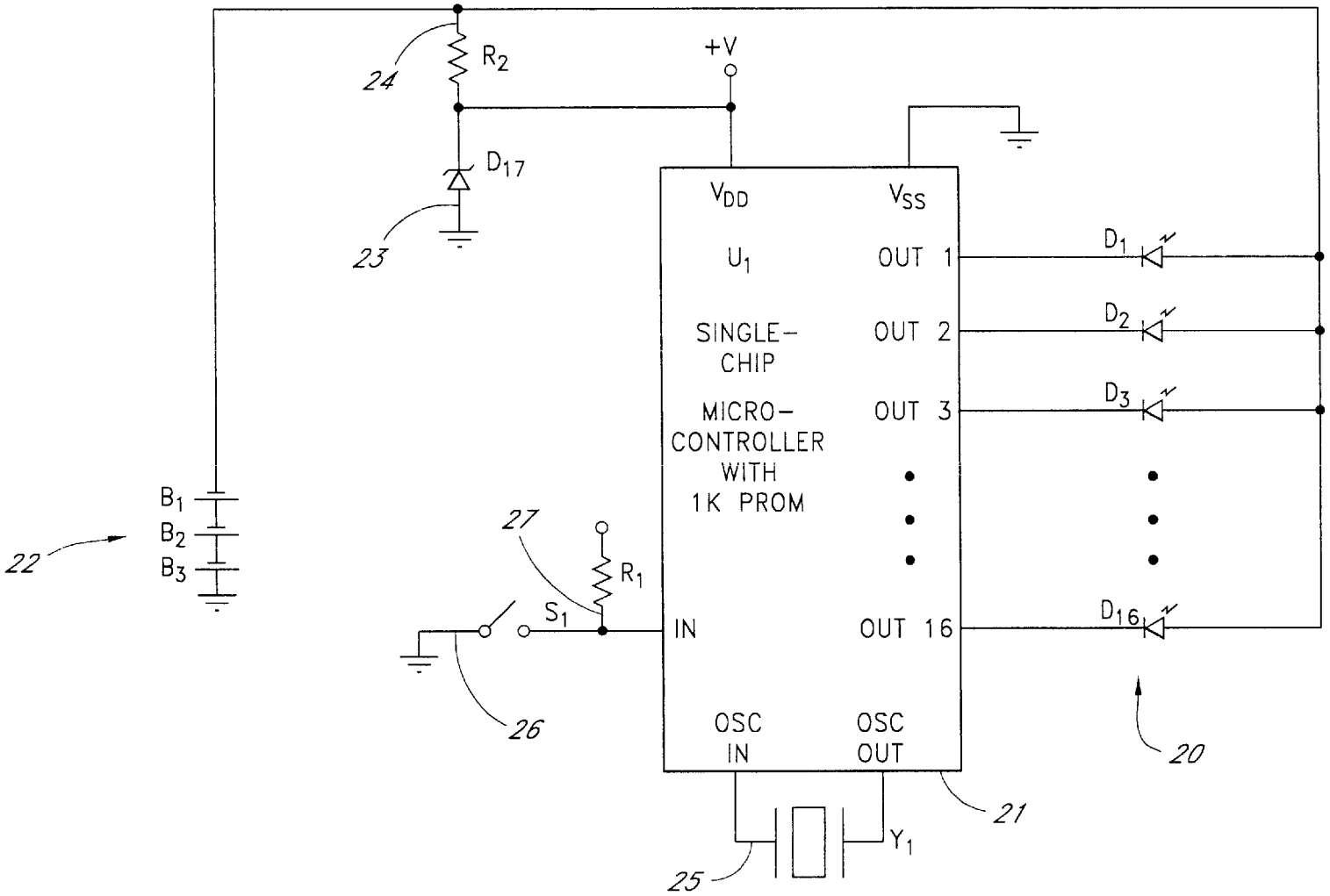
FIG. 4 shows a schematic diagram of an "imaginary image wand" using a persistent image maker with 16 LED's for the column of lights.

A schematic for an application of the "Persistent Image Maker" is given in FIG. 4. It is an example of a schematic of a "Persistent Image Maker" used for an "Imaginary Image Wand." It uses 16 LED's as the column of lights (20), a single-chip microcontroller with 1K of ROM (the ROM contains both the microcontroller's code and the images to be generated) (21), three AAA batteries (22) and a zener diode (23) and a resistor (24) for the power supply, a ceramic resonator for the time base generator (25), and a push-button switch (26) (the switch is used for on/off and for the user to tell the "Persistent Image Maker" to display the next stored image) (the resistor (27) is used as a pull-up). This implementation has no "back" and "forth sensor and no current limiting resistors.

Figure 5A:
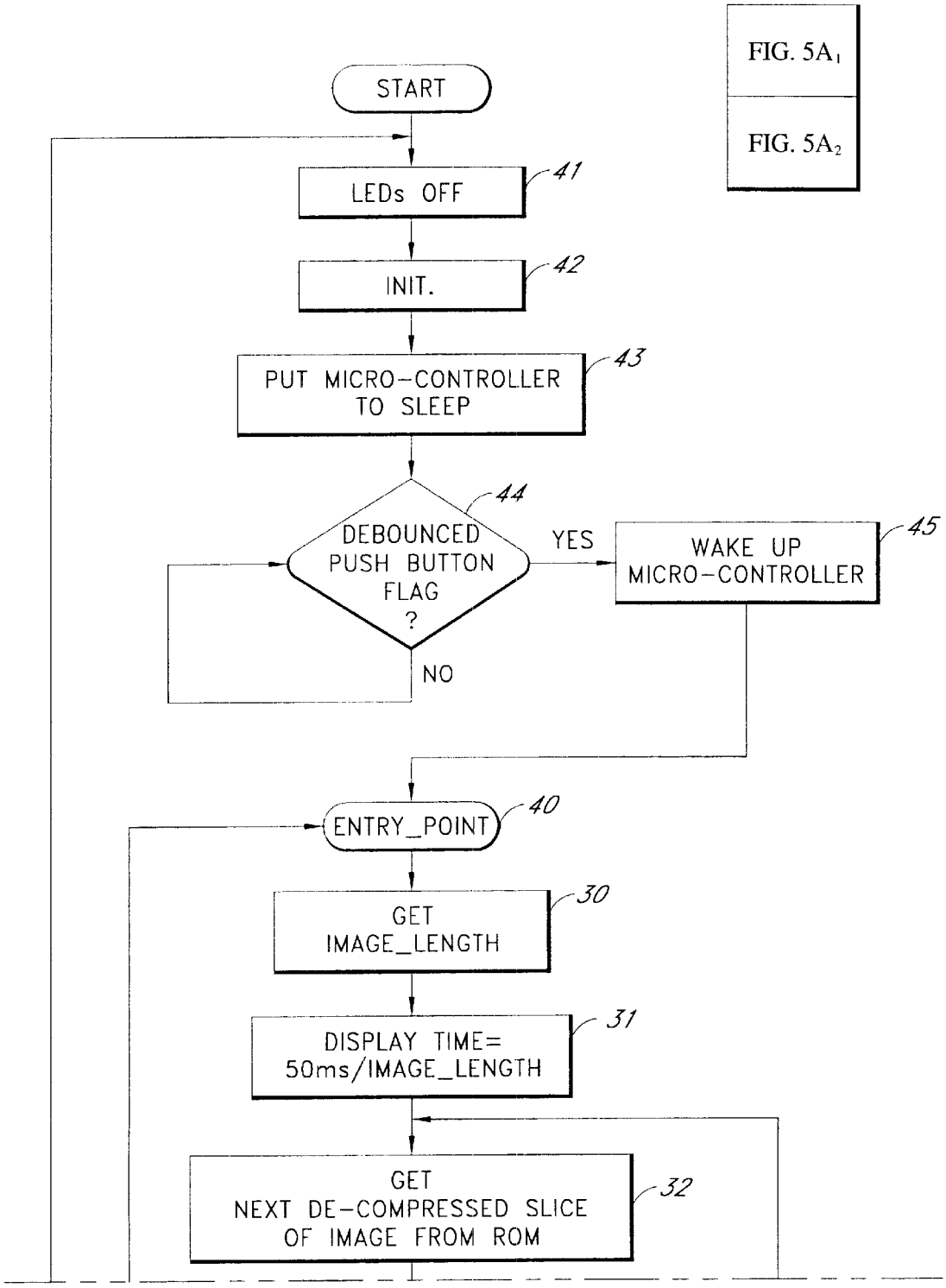
FIG. 5A (divided into 5$A_1$ and 5$A_2$) shows an example of a flow chart of the firmware control main program for a persistent image maker used in an "imaginary image wand."
Figure 5B:
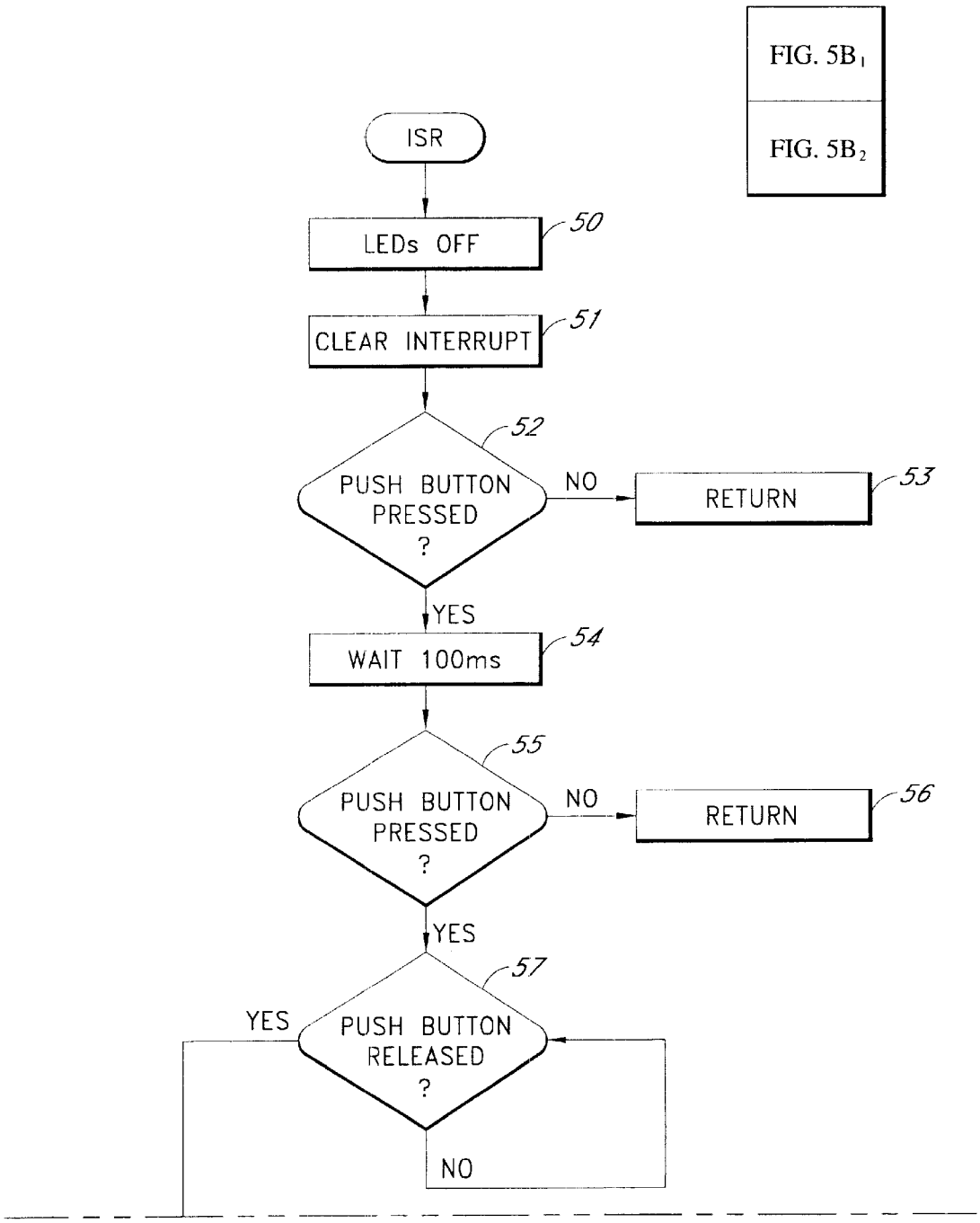
FIG. 5B (divided into 5$B_1$ and 5$B_2$) shows an example of a flow chart of the firmware control interrupt service routine for a persistent image maker used in an "imaginary image wand."

FIGS. 5*a* and 5*b* show an example of a flow chart of the Firmware control for a microcontroller used in a "Persistent Image Maker" used for an "Imaginary Image Wand."

Theory of Hardware Operation

The idea of the "Persistent Image Maker" is a cheap implementation of a single-column light display, intended to be used with the "Persistent Image Maker" in motion.

To reduce cost, the power supply consists only of battery (s) (22), one resistor (24) and one zener diode (23). The output of the zener diode (23) provides good enough regulation for the microcontroller (21). The LED's (20) are powered directly from the battery(s) (22).

Normally, in order to keep the microcontroller's (21) outputs from over-heating and burning out, costly line drivers are necessary for a microcontroller (21) to sink enough current to brightly light the LED's (20). Also, current limiting resistors are normally necessary to keep the microcontroller's (21) outputs (and/or the LED's (20)) from burning out. One of the main innovations of my implementation for the "Persistent Image Maker" is in eliminating the line drives (as well as the current limiting resistors in many cases). I avoid the costly line drivers (as well as the current limiting resistors in many cases) by pulsing the LED's (20) very quickly rather than just leaving them on when I want them to appear ON. So, in the following discussion, when I write that an LED (20) is "ON", it really means that it is being pulsed on for a very brief period, then off for long enough for the microcontroller (21) to dissipate the heat generated, then on again for the same brief period, etc.* Another advantage of pulsing the LED's (20) in this way is that they appear brighter than if they were left on, since the period of time that they are on (though very short) is one of intense brightness. [Experiments have shown that pulsing LED's for very short periods of intense brightness appear brighter than if the LED's are on continuously with its safe maximum current.]

In researching the range of useful timings for pulsing the LEDs (20) without line drivers or current limiting resistors, I found that the LEDs (20) may remain steadily On for a much longer period than I had originally thought with no damage to the microcontroller (21) (this is in part due to the series resistance. of the batteries (22) powering the LEDs (20)). As it turns out, the pulsing of the LEDs (20) that naturally occurs with most applications of the "Persistent Image Maker" is enough to guarantee that the microcontroller (21) will not be damaged. As such, for most applications of a "Persistent Image Maker" there is no need to pulse the LEDs (20) quickly rather than just leaving them ON. So, even though in the following discussion "ON" was originally intended to mean "pulsing ON and OFF quickly", it can be taken to actually mean steadily ON for most applications (though it is conceivable that with a battery (22) of high enough voltage and low enough series resistance, there may still be a need for "ON" to mean "quickly pulsing ON and OFF"). See Range of Timing Values, below for an explanation.

In the following pages for the discussion under *The ROM From the users point of view*, and under *Theory of Firmware* operation, a particular implementation of the "Persistent Image Maker" is described: an implementation of an "Imaginary Image Wand", shown schematically in FIG. 4. Operation for other implementations can be similar and can be readily adapted by those having ordinary skill in the art.

The ROM

Before anyone can use the "Persistent Image Maker", the ROM inside of the microcontroller (21) must be prepared (this is done in the factory (with a microcontroller ROM-burner) and not by the end user). The ROM contains the program that runs the "Persistent Image Maker", and also contains all of the images to be generated.

Each image stored is data-compressed (though it does not have to be if uncompressed images will fit in the ROM). To generate the images, I can best conceptually describe it by drawing the desired image on a sheet of graph paper (though the process is easily automated by drawing or scanning an image into a computer). The image is drawn so that it covers a maximum vertical distance of 16 squares. Then draw a "0" in any box that has a line from the drawing covering more than half of it. Then draw a "0" in any box that is shaded in on the drawing. Then draw a "1" in all of the other boxes. The image is now "digitized" into columns of 16 squares of "1"s and "0"s. Each column can be considered a slice of the entire image. There are a certain number of slices of the image (i.e., the number of columns of the image)—this number is defined as IMAGE_LENGTH. A table is made of these slices—in left-slice to right-slice order. (Later, in actual operation of the "Persistent Image Maker", when the image is being displayed, each one of these slices will be sent, in order, to the column of lights.) The table of slices is data-compressed for storage in the ROM. At the beginning of each image in ROM is its length (IMAGE_LENGTH). After the end of the last image stored in ROM, there is a byte with 00 stored in it to signify there are no more images in the ROM.

From the user's point of view

To use the "Imaginary Image Wand" (which has the column of lights (20) of a "Persistent Image Maker" mounted on the end of a wand), the user turns it on by pressing the push-button (26). The column of lights (20) immediately starts flickering. The user then can wave the "Imaginary Image Wand" back and forth to see the first image that it has stored in it. This image will be displayed until they press the push-button (26) again, at which point the next image will be displayed until they push the push-button (26) again, etc., until the last image is displayed. The next press of the push-button (26) will display the first image again. This image will be displayed until they press the push-button (26) again, etc. The "Imaginary Image Wand" will turn itself off if no one presses the push-button (26) for 30 seconds.

Theory of Firmware operation

To display an image, the program looks in ROM at the address of the first stored image. The first byte is IMAGE_LENGTH (30). Then a value is calculated: DISPLAY_TIME (31), which is the length of time to keep a slice of the image on the column of lights before updating the column of lights with the next slice of the image. DISPLAY_TIME= 50 msec/IMAGE_LENGTH so that the entire image is displayed in 50 msec which is IMAGE_TIME (a length of time, empirically derived, for easy perception of images—see Range of Timing Values, below). Then a slice is data-de-compressed from ROM (32) and sent to the column of lights (the LEDs) where they are left "ON" (remember, they are actually very quickly pulsed at intense brightness, and not just left On *) for DISPLAY_TIME (33). Then the LEDs are turned off (34). Then the next slice is data-de-compressed from ROM (32) and sent to the column of lights where they are left "ON" for DISPLAY_TIME (33) and the LEDs turned off (34), and the process continues until IMAGE_LENGTH slices (all slices) have been sent to the LEDs (35).

As stated above, I found that the LEDs may remain steadily On rather than quickly pulsing them, since the pulsing of the LEDs that naturally occurs with most applications of the "Persistent Image Maker" is enough to guarantee that the microcontroller and/or LEDs will not be damaged. See Range of Timing Values, below for an updated explanation.

There is a constant: BLANK_TIME=50 msec/3, which is the length of time that the column of lights is off after the last slice of the image is displayed and before the first slice is displayed again (a length of time, empirically derived, for easy perception of images—see Range of Timing Values, below). After all slices of an image have been sent to the LEDs, the LEDs are off for BLANK_TIME (37). Then the process of displaying this same image repeats. This is accomplished by pointing to the beginning ROM address of the image that just finished being displayed (36) (so that it is pointing, once again, to IMAGE_LENGTH for this image), before jumping back to get IMAGE_LENGTH (30), etc.

The same image is displayed until the user presses the push-button. This causes an interrupt (see FIG. 5*b*). The interrupt routine turns the LEDs off (50), clears the interrupt (51), and if the push-button is not still pressed (52), then the interrupt service routine returns (53) so that operation continues where it left off. Otherwise, it then waits 100 msec (54) to see if the push-button is still pressed (55). If it is not, the interrupt service routine returns (56) so that operation continues where it left off. If the push-button is still pressed, it waits for the user to then let go of the push-button (57), then waits 100 msec (58)—the Firmware debounces the push-button in this way. The debounced push-button FLAG is set to communicate this to the main program (59). Then the beginning address of the next image stored in ROM is calculated and pointed to (60). This points to IMAGE_LENGTH of this next image. Then the above display process continues for this new image.

After each debounced push-button press the interrupt service routine returns to Entry_Point (64 and 65 of FIG. 5*b* and 40 of FIG. 5*a*), and the above process is repeated for the next image stored in ROM (30 through 39 of FIG. 5*a*). (Alternatively, for implementations of the "Persistent Image Maker" without a push-button, each image can be displayed for a certain length of time (e.g., 5 sec) before going to the next image.)

After the last image stored in ROM has been displayed, the Firmware knows it is the last because IMAGE_LENGTH=00 for the "next" image (61 of FIG. 5*b*), so it then goes to the address of the first image stored in ROM (62 of FIG. 5*b*).

If there is no debounced push-button press within 30 sec, the program turns the "Persistent Image Maker" off. When it is off, the microcontroller is actually still running (so that it can detect the next push-button press), but it is put into sleep mode to conserve the batteries. The Firmware keeps track of the time between button presses by counting the number of times an image has been displayed—each display is 50 msec (IMAGE_TIME)+50/3 msec (BLANK_TIME); the interrupt routine clears the counter every time there is a debounced button press (63 of FIG. 5*b*). So, whenever the counter 38 counts up to 450 (which takes 30 seconds) (39 of FIG. 5*a*), the Firmware turns the LEDs off (41 of FIG. 5*a*), the Firnware is initialized (42 of FIG. 5*a*), and the microcontroller is put into sleep mode (43 of FIG. 5*a*). The "Imaginary Image Wand" will remain off until the next debounced push-button press 44, at which point the microcontroller is woken up to normal power mode (45 of FIG. 5*a*), and the images are displayed again.

RANGE OF TIMING VALUES

Definitions of the values that will be given ranges of values below

IMAGE_TIME—the amount of time to display an entire Image.

DISPLAY_TIME—the amount of time to display one vertical slice of an Image.

BLANK_TIME—the amount of Off time between re-displaying an Image.

BLANK_FACTOR_BLANK_TIME is this number of times less than IMAGE_TIME (BLANK_TIME may be an independent quantity, but having it be a ratio of IMAGE_TIME can make for simpler controlling firmware.)

IMAGE_LENGTH—the number of vertical slices of an Image.

LED On time—length of time an LED is On before turning Off again without damaging the microcontroller and/or LEDs.

LED Off time—length of time an LED is Off before turning On again without damaging the microcontroller and/or LEDs.

In researching the range of useful timings for pulsing the LEDs without line drivers or current limiting resistors, I found that the LEDs may remain steadily On for a much longer period than I had originally thought with no damage to the microcontroller and/or LEDs (this is in part due to the series resistance of the batteries powering the LEDs). As it turns out, the pulsing of the LEDs that naturally occurs with most applications of the "Persistent Image Maker" is enough to guarantee that the microcontroller and/or LEDs will not be damaged.

The microcontroller and/or LEDs will be damaged only if LED On time is too long or LED Off time is too short. If LED On time is too long the microcontroller and/or LEDs will heat up too much. If LED Off time is too short, the microcontroller and/or LEDs will not be able to cool down enough before being heated up again when LEDs are turned On again.

For most applications of a "Persistent Image Maker" IMAGE_TIME is short enough to be the same as LED On time, and BLANK_TIME is long enough to be the same as LED Off time. As such, there is no need to be concerned with the LED On time and the LED Off time for most applications, i.e., when it is time to turn a slice of an image On in the LEDs for DISPLAY_TIME, they do not need to be quickly pulsed On and Off (and the LEDs may be connected directly to the microcontroller outputs without current limiting devices). It is, however, conceivable that in some application(s) there may be a need to use a battery with a high enough voltage and with low enough series resistance so that LED On time needs to be less than IMAGE_TIME (to not damage the microcontroller); in this case, it will be necessary to either add current limiting devices in series with the LEDs, and/or to quickly pulse the LEDs On and Off while they are "ON" for DISPLAY_TIME.

When the LEDs are "ON" it really means that they are being pulsed quickly On and Off so that they appear On to a human eye—the quick pulsing is to ensure that no damage is done to the microcontroller (and/or LEDs) due to excess current that will heat the devices too much. I found that for most applications that I can think of now there is no need for the quick pulsing at all—so when the LEDs are "ON", they can just be steadily On. This is because there is a "natural" pulsing that occurs in the normal operation of the "Persistent Image Maker": the worst case for heating the devices would be displaying an Image which is a solid shaded in rectangle; while the rectangle is being displayed all of the LEDs are On for IMAGE_TIME, then all of the LEDs are turned Off for a period of time (BLANK_TIME) before re-displaying the rectangle again for IMAGE_TIME (the BLANK_TIME is necessary so that humans can perceive some distance between the Image). It turns out that this "natural" pulsing rate will ensure that the LEDs are never On long enough to heat up the microcontroller (and/or LEDs) too much before they are allowed to cool down during BLANK_TIME, which is long enough for them to cool down before they are turned On again.

RANGE OF VALUES FOR ABOVE

IMAGE_TIME=30 to 200 msec depending on speed of movement of the vertical column lights and the desired apparent width of the perceived Image. (May be calculated or empirically derived.) (Value depends on the particular application.)

DISPLAY_TIME=IMAGE_TIME/IMAGE_LENGTH.

BLANK_FACTOR=1 to 10 empirically derived for easily perceived images. (Depends on the particular application.)

BLANK_TIME =IMAGE-TIME/.BLANK-FACTOR. (Alternatively, this quantity may be independent from IMAGE_TIME.)

IMAGE_LENGTH=1 to 64 empirically derived for easily perceived images. (Depends on the particular application.)

LED On time=30 micro-sec to 200 milli-sec any less and LED appears too dim, any more isn't too useful for this project. (Same as IMAGE_TIME for most applications.)

LED Off time—1/10 of LED On time to 1/1 of LED On time any less and the single-chip microcontroller could fry, any more isn't too useful for this project. (Same as BLANK_TIME for most applications.)

For most applications, it is not necessary to use the quantities LED On time or LED Off time. It is conceivable, however, that with a battery of high enough voltage and low enough series resistance, LED On time=IMAGE_TIME may be too long (the microcontroller and/or LEDs may be damaged by excess current for too long of a period of time). If this is the case:

LED On time will need to be some percentage of IMAGE_TIME

LED Off time must be less than 880 micro-seconds, otherwise the pulsing of the LEDs will be noticeable to the user it will be necessary to quickly pulse the LED On for LED On time and Off for LED Off time while a vertical slice of an Image is are "ON" the vertical column of lights for DISPLAY_TIME.

alternatively, or in addition to the above 3 points, current limiting devices may be put in series with the LEDs.

One of ordinary skill in the art can readily appreciate the persistent image maker can be adapted for a number of purposes not explicitly exemplified herein. The examples provided herein are in no way intended to be limiting on the scope of the present invention, as the scope of the invention is to be interpreted in connection with the following claims.

What is claimed is:

1. A method of creating an image for an event or promotion, comprising:

providing a plurality of light sources connected to electrical circuitry, said light sources and electrical circuitry powered by a power source, wherein said light sources are arranged in a one-dimensional matrix, said one-dimensional matrix comprising a vertical column and a plurality of horizontal rows in which each of said horizontal rows has no more than one of said light sources;

providing power from said power source to said electronic circuitry and light sources without use of a hine driver, said power source having a voltage and series resistance such that maximum power dissipation for any component of the electronic circuitry or light souces is not exceeded whether or not current limiting devices are present in said electronic circuitry;

blinking each of said, light sources for a plurality of image_times that are within the range from about 30 milliseconds to about 200 milliseconds without damaging the light sources or electronic circuitry controlling the light sources, each of said image times comprising one or more display_times that are equal to LED On time; and moving the plurality of light sources relative to an observers at said event or promotion, such that said observers will observe a two-dimensional image pertinent to said event or promotion.

2. The method of claim 1, wherein each of said image_times is followed by a blank_time within the range from about 880 microseconds to about 200 milliseconds.

3. The method of claim 2, wherein each of said image_times is followed by a blank_time within the range from about 3 milliseconds to about 200 milliseconds.

4. The method of claim 1, additionally comprising displaying a second two-dimensional image by modifying instructions to the light sources from the electronic circuitry.

5. The method of claim 1, wherein the blinking is accomplished without a line driver.

6. The method of claim 1, wherein the blinking is accomplished without a current limiting device.

7. The method of claim 5, wherein the blinking is accomplished without a current limiting device.

8. The method of claim 1, wherein the light sources are LEDs.

9. The method of claim 1, wherein the light sources are on an implement that comprises a back and forth sensor, wherein the back and forth sensor turns the electronic circuitry on and off or identifies which direction the implement is travelling and places the two-dimensional image in a single orientation regardless of which direction the implement is travelling.

10. The method of claim 1, wherein the electronic circuitry comprises a RAM that stores variables in a program controlling the two-dimensional image created by the moving of the plurality of light sources.

11. The method of claim 1, wherein the image is created for an event selected from the group consisting of birthdays, celebrations, street fairs, concerts, sports events, conventions, and political events.

* * * * *